US005084926A

United States Patent [19]

Wattie et al.

[11] Patent Number: 5,084,926

[45] Date of Patent: Feb. 4, 1992

[54] CONTOUR PILLOW

[75] Inventors: James A. Wattie; Joanne M. Wattie, both of Leicester, England

[73] Assignee: National Research Development Corporation, London, England

[21] Appl. No.: 543,805

[22] PCT Filed: Dec. 11, 1989

[86] PCT No.: PCT/GB89/01475

§ 371 Date: Jul. 23, 1990

§ 102(e) Date: Jul. 23, 1990

[87] PCT Pub. No.: WO90/06708

PCT Pub. Date: Jun. 28, 1990

[30] Foreign Application Priority Data

Dec. 15, 1988 [GB] United Kingdom ..... 8829313

[51] Int. Cl.[5] ..... A47G 9/00

[52] U.S. Cl. ..... 5/636; 5/901

[58] Field of Search ..... 5/434, 436, 441, 442

[56] References Cited

U.S. PATENT DOCUMENTS

| | | | |
|---|---|---|---|
| 2,107,622 | 8/1939 | Bentivoglio | 5/442 X |
| 3,667,074 | 6/1972 | Emery | 5/436 |
| 4,320,543 | 3/1982 | Dixon | 5/436 X |
| 4,850,067 | 7/1989 | Latorre | 5/436 X |
| 4,850,068 | 7/1988 | Walpin et. al. | 5/436 X |

*Primary Examiner*—Michael F. Trettel

*Attorney, Agent, or Firm*—Nixon & Vanderhye

[57] ABSTRACT

A pillow is of rectangular form having front and rear rolls (17,18) at its longer sides and side rolls at its shorter sides, upper and lower surfaces (15, 16) of the pillow having respective large, central recessed areas (19, 20) between the front and rear rolls, the rolls being interrupted by minor recesses (**21, 22 21*a*, 22*a*30, 31) extending from respective sides of the pillow into the central recessed areas of the upper and lower surfaces respectively, the front and rear rolls forming on each surface a central main buttress and together with the side rolls forming four corner buttresses, side buttresses also being formed between pairs of adjacent corner buttresses respectively, the side buttresses tapering in width and height away from their respective associated sides of the pillow into a central recessed area (19, 20**).

23 Claims, 3 Drawing Sheets

CONTOUR PILLOW

BACKGROUND OF THE INVENTION

Field of the Invention

This invention relates to improvements in or relating to pillows, particularly pillows formed of deformable moulded rubber or plastics material, and has as its object the provision of a pillow in a convenient and effective form. As used herein, the word 'pillow' includes analogous items, such as cushions.

SUMMARY OF THE INVENTION

According to the present invention there is provided a pillow having upper and lower surfaces and at least one peripheral surface therebetween, at least one of the upper and lower surfaces having a central recessed area and respective first buttress portions at opposite sides thereof extending to said at least one peripheral surface, a pair of second buttress portions each extending to said at least one peripheral surface being disposed adjacent to and at respective opposite sides of one of the first buttress portions and spaced therefrom by respective further recessed areas extending from said central recessed area to said at least one peripheral edge.

BRIEF DESCRIPTION OF THE DRAWINGS

The invention will now be described, by way of example, with reference to the accompanying drawings, in which.

DETAILED DESCRIPTION OF PREFERRED EMBODIMENTS

Figure 1:
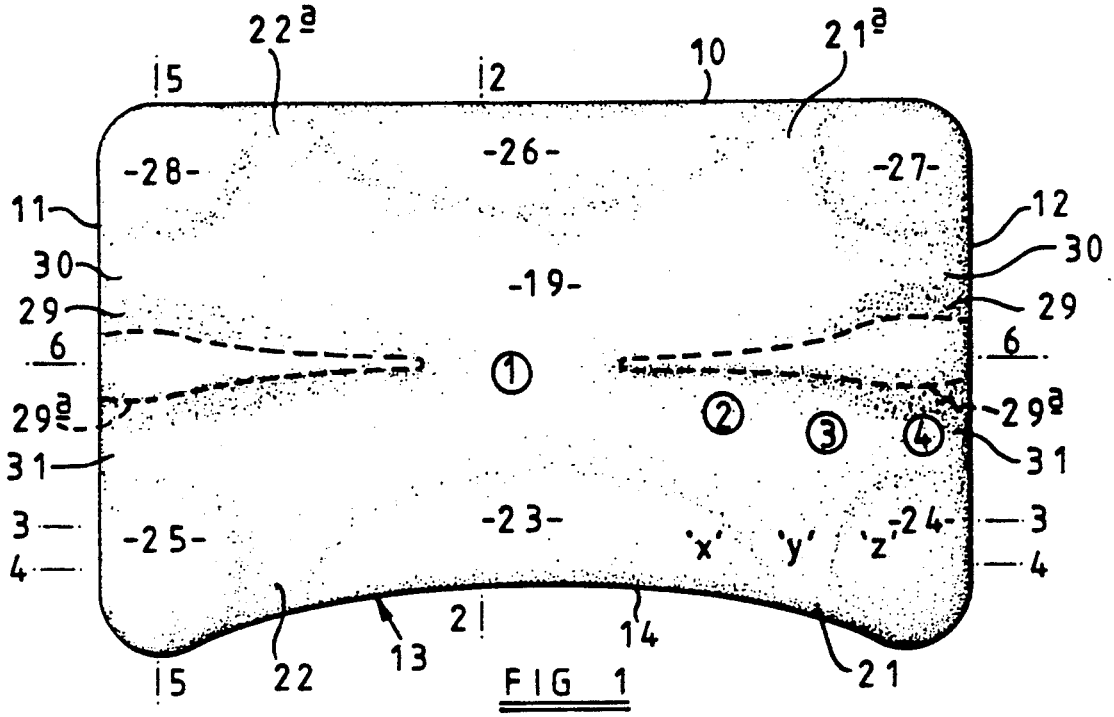
FIG. 1 is a top plan view of a pillow of the invention.
Figure 2:
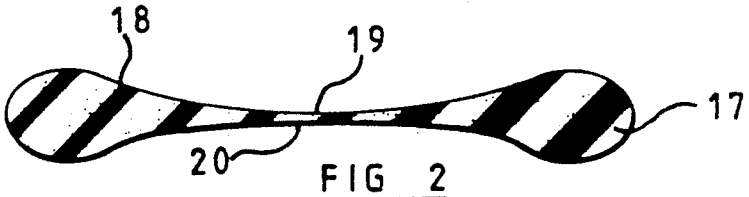
FIG. 2 is a cross-section on the line 2—2 of FIG. 1.
Figure 3:
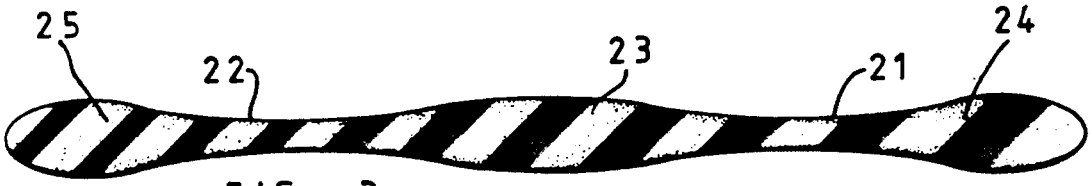
FIG. 3 is a schematic cross-section on the line 3—3 of FIG. 1.

The pillow shown in the drawings is moulded from latex material or soft polyurethane either as one piece or in two identical, upper and lower halves, which are adhered together thereafter. The pillow is intended for use as an underpillow, with a top pillow of a user's own choice, i.e. foam, feather or man-made fibre filled, being used on top of the underpillow. Thus the user's head is only indirectly received on the underpillow.

The pillow is of generally rectangular shape in plan, having a straight rear edge or side surface 10, shorter straight transverse edge or side surfaces 11, 12 respectively, and a front edge or side surface 13 which is concave and thus defines a bright 14. The depth of the pillow is small as compared to the depth of conventional top pillows. The pillow has upper and lower surfaces 15, 16 respectively.

In alternative constructions of the pillow, the front and rear edges could both be straight, or both concave, and moreover either or both of the surfaces 15, 16 could be slightly convex instead of flat.

The pillow has front and rear rolls 17, 18 respectively, and also side rolls, of generally ovoid shape, i.e. with generally flattened upper and lower surfaces. Respective identical, central, large concave recessed areas 19, 20 are formed in the upper and lower surfaces and as the pillow is in fact symmetrical about a plane midway through it and parallel to upper and lower surfaces, i.e., through the front and rear rolls. The recesses overlie one another in a direction normal to the surfaces 15, 16. With the recessed areas 19, 20 the term 'large' is used in comparison in surface area with the area of load (head) applied to the upper surface, in use.

On both its upper and lower surface the front roll 17 has a pair of symmetrically, longitudinally spaced apart minor recesses 21, 22 which effectively extend from the central recessed area to the front edge surface 13 of the pillow. The front roll is thus divided into a middle section or central buttress 23 and outer corner sections or major buttresses 24, 25 respectively. The inner boundary of each of these three sections of the front roll is convexly curved, as can be seen in FIG. 1. The rear roll 18 is similarly arranged on its upper and lower surface having a middle section or central buttress 26 and corner or major buttresses 27, 28 respectively, with minor recesses 21*a*, 22*a* therebetween.

As stated, the buttresses 24, 25 and 27, 28 are corner buttresses, and they are in fact formed partly by the respective side rolls as they extend along the shorter sides of the pillow. On its upper and lower surfaces each side roll has respective side or minor buttresses 29 extending inwardly from the side surface. Each side buttress is of generally triangular shape, tapering down away from its side surface and also towards its adjacent corner buttresses. Additionally the buttress is at the level of the corner buttresses at its junction with the side surface, but it slopes towards the central recessed area and thus reduces in height until it runs into said central recessed area.

Figure 4:
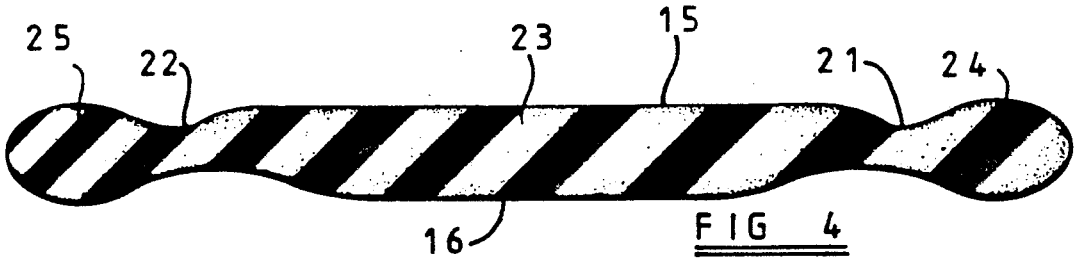
FIG. 4 is a schematic cross-section on the line 4—4 of FIG. 1.
Figure 5:
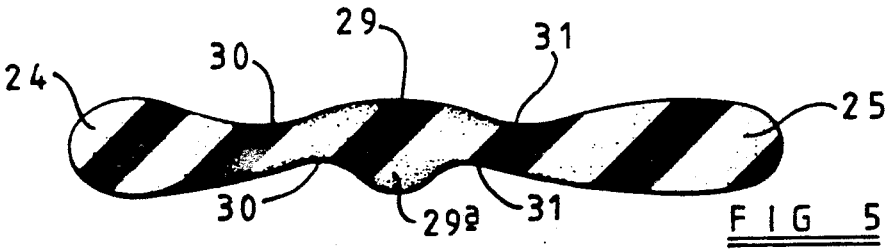
FIG. 5 is a schematic cross-section on the line 5—5 of FIG. 1, but showing an alternative underside form of the pillow.
Figure 6:
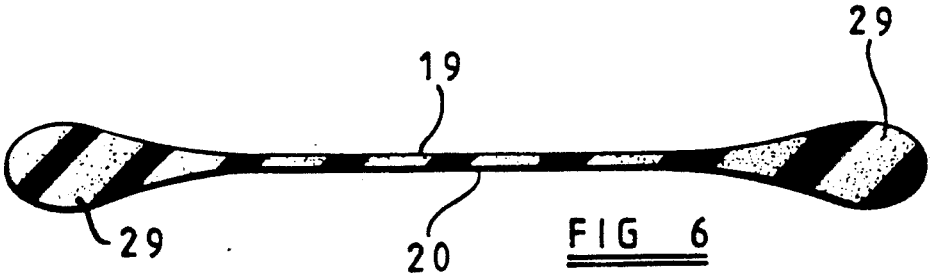
FIG. 6 is a cross-section on the line 6—6 of FIG. 1, FIGS. 7 and 8 are fragmentary enlarged cross-sections on the line 4—4 showing how the pillow alters its shape, in use.

Although, as described, the upper and lower buttresses 29 are identical, the lower buttresses can be slightly less wide, as indicated at 29*a* by the dashed lines in FIG. 1, and as shown in FIG. 5. Moreover, as shown in FIG. 4, the lower central buttress could be of shorter length than the upper central buttress for the front and/or rear of the pillow.

Between the buttresses 29 and the front and rear corner buttresses adjacent thereto are respective further minor recesses 30, 31 which like the recessed areas 21, 22 effectively extend from the central recessed area, to the respective side surfaces 11, 12. Each minor recess 21, 21*a*, 22, 22*a*, 30 and 31 widens outwardly, i.e. away from its associated side surface.

In use, with the pillow used either way up, a conventional top pillow is placed on the top surface of the underpillow and the user's head acts through the top pillow and onto the recessed area and/or rear roll of the underpillow with the user's neck similarly acting through the top pillow onto the supporting, i.e. non-recessed area of the underpillow, namely the front roll.

The manner in which the pillow supports the head and neck of a user will now be explained, firstly generally with reference to FIGS. 1, 7 and 8, and then in more detail with reference to FIG. 9.

Figure 7:
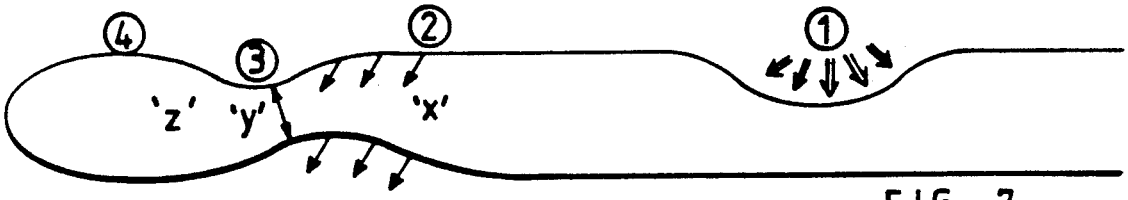
Figure 8:
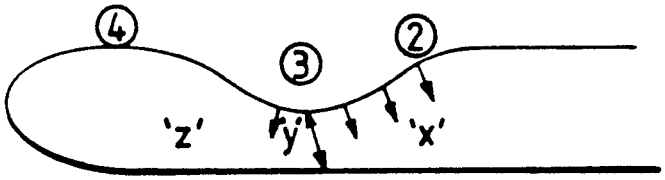

In position (1) shown in FIGS. 1, 7 and 8, the user's neck is supported by the front roll, while the back of the head or the side of the face (if the user is lying on the side) occupies area around (1) with the top of the head being supported by the rear roll. The central area is slightly concave and this is accentuated by the weight of the user's head. The side buttresses 29 shown in FIG. 1 taper, slope and are curved, providing support as the user's head moves laterally from the transverse midline of the pillow, usually in an arc to positions (2), (3) or (4).

In the second position, the neck remains supported by the front roll, whilst the back of the head or side of the face lies in the recess at (2). The back of the head begins to be supported by the central buttresses. The curved shape facilitates free arcuate movement of the head laterally. A 'graduated cradling effect' is now starting at approximately point 'x' (FIGS. 7 and 8), as the lateral part of the front roll depresses towards the surface of the bed, or other article on which the pillow rests, due to the weight of the user's neck, as indicated by the arrows in FIG. 7.

Position (3) shows the neck now at 'y' (FIGS. 7 and 8) with maximum 'cradling effect', in conjunction with corner buttress 'z'. The back of the head or the side of the face is at (3) with the top of the head now obtaining more support from the central buttress. The recess narrows towards the side of the pillow due to the curved shape of the central and corner buttresses, which provide gradually increasing support as the head moves towards position (4) so preventing the head slipping off the end of the pillow. A further advantage is that if the sleeper is facing laterally (i.e. with the side of the face on the pillow) there is a much reduced tendency for the pillow lateral to the side of the face to impinge upon the sleeper's nose.

The upper recess areas (2), (3) and area (4) in particular tend to retain the head in the same plane relative to the plane of the surface of the bed, further aided by the lower surface asymmetric recess 30 or 31 (FIG. 5), which provides an increased cradling effect for the head towards the transverse centre line of the pillow. This combined recess effect avoids elevation of the head during extreme arcuate movement or lateral positions of the head (if user lying to either side of the pillow midline) in relation to the plane of the bed surface.

Recent medical research has suggested an increased risk of a sleeper developing the sleep apnoea syndrome, where the sleeper's head flexes excessively in relation to the neck during sound sleep. The underpillow of the invention, when used with a top pillow of e.g. latex foam, man-made fibre, feather or down, will maintain the head in an optimum position relative to the neck and also correctly support the neck and its position relative to the shoulders.

The provision of a major recess in the upper surface of the pillow as well as in the lower surface allows natural deformation of the top pillow to be readily accommodated by the underpillow whilst still providing sufficient support.

Considering now the various areas of the pillow in detail, the recesses of the pillow are concerned with supporting loads perpendicular to the horizontal plane of the pillow, and in addition loads acting and moving in planes parallel to the plane of the pillow. A single, central major recess with eight peripheral minor recesses is provided in each of the upper and lower surfaces of the pillow. These recesses are concerned with load support and transfer across surface planes of the pillow, in conjunction with a top pillow.

The major recesses 19, 20 gradually reduce in depth towards the front and rear rolls and also towards the lateral sides of the pillow by virtue of the varying cross-sectional shape of the central pad of the pillow. The major recesses lead into the minor recesses by relatively wide openings which narrow progressively towards the peripheral part of each minor recess in the horizontal plane and also in the vertical plane (due to progressive thickening of the pad in the floor of opposing upper and lower surface minor recesses towards the periphery). Both major and minor recesses progressively widen away from the surface plane of the pillow, i.e. they are upwardly (outwardly) widening.

All upper and lower surface recesses narrow towards each other, i.e. towards the horizontal mid plane of the pillow. The minor recesses between buttresses and also between rolls and buttresses function synergistically to provide variation in vertical and horizontal load support (cradling) and transfer.

As described previously, the corner and side buttresses have a variable convex shape outwards from the horizontal plane of the pillow, with a gentle taper towards their apex, to be dome-shaped. They thus provide a gradually variable material counterforce to perpendicular loads moving in a horizontal plane. There is synergism of function between buttresses or a buttress and a roll in conjunction with the recesses. Buttresses are gently spread apart by simultaneous perpendicular and horizontal plane loads, so the head and neck are cradled.

Figure 9:
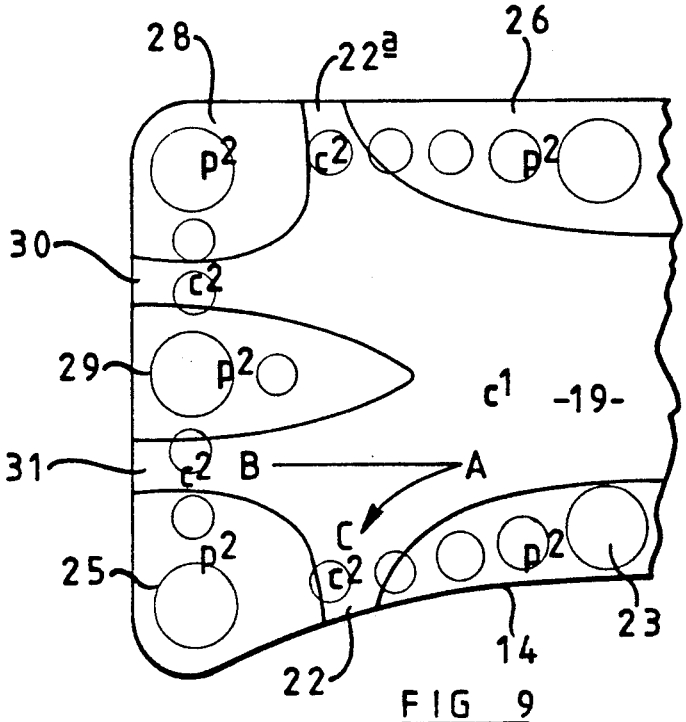
FIG. 9 is a fragmentary view of the upper surface of the pillow schematically showing various areas defined thereon.

FIG. 9 shows the various regions of the base part discussed above, with $c^1$ denoting the central area of the major recess 19, $c^2$ the central area of the minor recesses and $p^2$ the highest point of a major buttress or roll.

A load moving in the horizontal plane from A to B will encounter progressively increasing vertical and horizontal plane counterforces by virtue of the narrowing of minor recess $c^2$, the main buttresses outline shape and convexity, together with the minor buttress, acting synergistically. Similar counter-forces also act on a load moving in the direction A-C. The possibility of excessive arcuate movements of the head and neck is reduced by the synergistic actions of roll, buttresses and recesses.

Considering a section through a minor recess, e.g. line B-A, there is a gradual increase of 'pad' thickness towards the sides of the pillow and also towards the front and rear rolls. This results in pad counterforces gradually increasing towards the periphery. The major recess areas both have a reducing volume towards both the sides and the front and rear rolls.

The cradling effect of the minor recesses is further enhanced by their opposing configuration. A load applied in the region of an upper surface minor recess will result in depression of the intervening pad and its peripheral portion, viz. the minor buttress, towards the surface of the bed or other supporting surface. Further application of load will result in vertical compression of the pad material itself. The gradual progressive cradling effect of the lower surface minor recess can be further enhanced if it has an asymmetrical shape compared to its opposite surface minor recess. The laterally moving load in such a case has, for example, a relatively greater volume of lower surface minor recess to obliterate, resulting in a more gradual, progressive cradling effect.

Similar principles apply to all other recesses, including upper and lower surface major recesses.

The front and rear rolls have a specific shape and function, i.e. the curvature of the front roll/plan view, the straight rear roll and the taper of both rolls from their mid points towards their lateral limits at their junctions with the minor recesses. In plan view the front roll tapers asymmetrically. Only the medial (inner) border of the rear roll tapers. In front elevation the front-/rear roll may taper towards its lateral limits symmetrically or asymmetrically.

The rolls provide a progressively reducing counterforce to the head and neck towards their lateral limits, particularly during arcuate movements of the head and neck towards a minor recess. This reducing counterforce is balanced by an increasing counterforce of the centripetal part of the side buttress and then the front buttress. As previously described, cradling of the head and neck occurs by synergism between roll, buttress (front and side) and the minor recesses thus reducing the possibility of the head moving beyond the front or side limits of the pillow, particularly during sound sleep.

Figure 10:
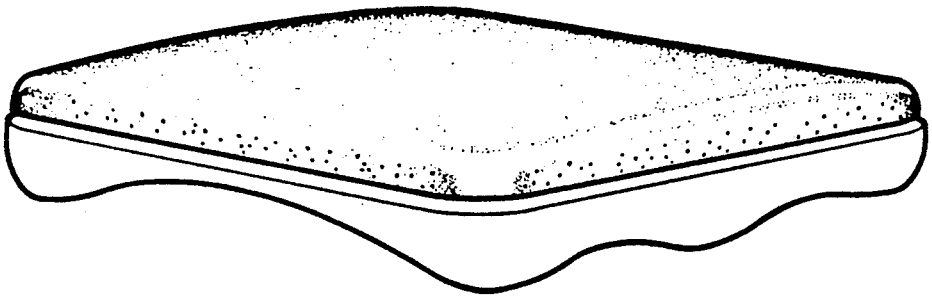
FIG. 10 is a perspective view of an alternate embodiment of pillow formed of two parts secured together.

The symmetrical nature of the pillow makes it relatively easy to manufacture. However as mentioned it could be produced by adhering together two identical halves as shown in FIG. 10. Additionally one half could be made deeper than the other. In an alternative embodiment, the lower half of the underpillow has secured, preferably adhered, to its non-recessed flat upper surface the flat base surface of a top part having a wholly smooth upper, outer surface. With such a construction the cradling effect is carried out by the undersurface of the pillow. The upper half of the pillow, i.e. the part with the smooth upper surface, would be moulded in latex material of a density less than that of the lower half, so that the top half would provide sufficient 'give' to accommodate natural deformation of the top pillow.

Small, circular section relief holes can be provided, for softening purposes, in the six buttresses and in the middle sections of the rolls 17, 18 as shown in FIG. 9 if required. If the underpillow is a one-piece moulding the holes would be open at one or both of the upper and lower surfaces of the underpillow, but if made in two halves, each relief hole could be formed by respective semi-circular recesses in the flat surfaces of each half to be adhered together, so that an internal spherical relief space is formed in the finished article.

Thus in summary the underpillow of the invention:

i) provides correct support for the head and neck of a user during sleep and therefore improves sleeping comfort for all users of all ages. The pillow does not seek to position the head in a central fixed position by a central recess totally surrounded by raised portions;

ii) is of special benefit to people who complain of a stiff, painful neck and shoulders and associated headache on awakening. Correct support of the head and neck during sleep avoids overstretching of muscles, tendons and ligaments and also reduces the risk of aggravating any underlying osteoarthritis in cervical vertebrae, disc prolapse and/or cervical nerve root pressure;

iii) reduces the risk to the user of developing the sleep apnoea syndrome.

We claim:

1. A pillow having an upper outer surface, a lower outer surface, said upper and lower surfaces are on opposite sides of a plane, and at least one peripheral outer surface therebetween, at least one of said upper outer surface and lower outer surface having a large central recessed area one of said upper outer surface and lower outer surface also including two first buttress portions at opposing sides with respect to said recessed area and extending to said at least one peripheral outer surface, a first pair of second buttress portions, each of said second buttress portions extending to said at least one peripheral outer surface and disposed adjacent to one of said first buttress portions and further recessed area means for spacing said one of said first buttress portions from said second buttress portions, said recessed area means extending from said central recessed area to said at least one peripheral outer surface, further including a second pair of second buttress portions, said further recessed area means including first and second pairs of further recessed areas, wherein said first pair of said second buttress portions is located adjacent to and on opposite sides of said one of said first buttress portions and spaced from said one of said first buttress portions by said first pair of said further recessed areas, and said second pair of said second buttress portions is located adjacent to and on opposite sides of the other of said first buttress portions and spaced from said other of said first buttress portions by said second pair of further recessed areas.

2. A pillow as claimed in claim 1, wherein between adjacent ones of the two pairs of second buttress portions respectively are respective minor buttress portions.

3. A pillow as claimed in claim 2, wherein between each minor buttress portion and an adjacent second buttress portion is a minor recess area extending from said central recessed area to said at least one peripheral outer surface.

4. A pillow as claimed in claim 2, wherein each side or minor buttress portion is of tapering shape towards the central recessed area, reducing in width, in the plane of the pillow.

5. A pillow as claimed in claim 4, which is asymmetric about a plane mid-way between its upper and lower surfaces by virtue only of side buttress portions on the lower surface being less wide than side buttress portions on the upper surface respectively.

6. A pillow as claimed in claim 1 wherein respective boundaries of each of the first and second buttress portions with said central recessed area are generally convex in the plane of the pillow.

7. A pillow as claimed in claim 1, formed in one piece.

8. A pillow as claimed in claim 7, moulded from latex material.

9. A pillow as claimed in claim 1, formed by two halves being adhered together.

10. A pillow as claimed in claim 9, comprised of a first half and a second half, said halves moulded from latex material being adhered together.

11. A pillow having an upper outer surface, a lower outer surface, said upper and lower surfaces are on opposite sides of a plane, and at least one peripheral outer surface therebetween, at least one of said upper outer surface and lower outer surface having a large central recessed area one of said upper outer surface and lower outer surface also including two first buttress portions at opposing sides with respect to said recessed area and extending to said at least one peripheral outer surface, a first pair of second buttress portions, each of said second buttress portions extending to said at least one peripheral outer surface and disposed adjacent to one of said first buttress portions and further recessed area means for spacing said one of said first buttress portions from said second buttress portions, said recessed area means extending from said central recessed area to said at least one peripheral outer surface, wherein said pillow is of rectangular configuration, having longer front and rear peripheral outer surfaces, and shorter peripheral outer side surfaces, said first buttress portions being formed by respective front and rear rolls which define said front and rear peripheral outer surfaces respectively, each of said front and rear rolls also partly defining at its respective opposite ends second buttress portions in the form of corner buttresses, each corner buttress being spaced from its adjacent first buttress portion by a further recessed area in the form of a minor recess.

12. A pillow as claimed in claim 11, wherein respective side rolls define said shorter peripheral side surfaces and partly define said corner buttresses.

13. A pillow as claimed in claim 12, wherein formed as part of said side rolls are respective minor or side buttress portions, each disposed centrally between corner buttresses of the front and rear rolls respectively.

14. A pillow as claimed in claim 13, wherein between each side buttress portion and an adjacent corner buttress is a minor recess extending from said central recessed area to a side surface.

15. A pillow as claimed in claim 13, wherein the first buttress portions, the corner buttresses and the side buttress portions are all at the same height at the peripheral surfaces of the pillow and all slope towards the central recessed area.

16. A pillow as claimed in claim 11, wherein each of the front and rear rolls is of ovoid transverse cross-section.

17. A pillow having an upper outer surface, a lower outer surface, said upper and lower surfaces are on opposite sides of a plane, and at least one peripheral outer surface therebetween, at least one of said upper outer surface and lower outer surface having a large central recessed area one of said upper outer surface and lower outer surface also including two first buttress portions at opposing sides with respect to said recessed area and extending to said at least one peripheral outer surface, a first pair of second buttress portions, each of said second buttress portions extending to said at least one peripheral outer surface and disposed adjacent to one of said first buttress portions and further recessed area means for spacing said one of said first buttress portions from said second buttress portions, said recessed area means extending from said central recessed area to said at least one peripheral outer surface, wherein there is a central recessed area in each of the upper and lower surfaces respectively, said central recessed areas at least in a partly overlapping relationship in a direction perpendicular to said surfaces.

18. A pillow as claimed in claim 17, which is symmetrical about a plane mid-way between its upper and lower surfaces.

19. A pillow having an upper outer surface, a lower outer surface, said upper and lower surfaces are on opposite sides of a plane, and at least one peripheral outer surface therebetween, at least one of said upper outer surface and lower outer surface having a large central recessed area one of said upper outer surface and lower outer surface also including two first buttress portions at opposing sides with respect to said recessed area and extending to said at least one peripheral outer surface, a first pair of second buttress portions, each of said second buttress portions extending to said at least one peripheral outer surface and disposed adjacent to one of said first buttress portions and further recessed area means for spacing said one of said first buttress portions from said second buttress portions, said recessed area means extending from said central recessed area to said at least one peripheral outer surface, wherein there are respective first buttress portions on said upper and lower surfaces respectively, the lower first buttress portion being of shorter length than the upper first buttress portion.

20. A pillow having an upper outer surface, a lower outer surface, said upper and lower surfaces are on opposite sides of a plane, and at least one peripheral outer surface therebetween, at least one of said upper outer surface and lower outer surface having a large central recessed area one of said upper outer surface and lower outer surface also including two first buttress portions at opposing sides with respect to said recessed area and extending to said at least one peripheral outer surface, a first pair of second buttress portions, each of said second buttress portions extending to said at least one peripheral outer surface and disposed adjacent to one of said first buttress portions and further recessed area means for spacing said one of said first buttress portions from said second buttress portions, said recessed area means extending from said central recessed area to said at least one peripheral outer surface, said pillow further comprising a base part and a top part, the base part having a central recessed area in its lower surface only, and a non-recessed upper surface, said top part having a non-recessed lower surface to which said non-recessed upper surface of the base part is secured, said top part having a wholly smooth outer surface.

21. A pillow as claimed in claim 20, wherein the top part is moulded of latex material of a density less than that of the base part.

22. A pillow having an upper outer surface, a lower outer surface, said upper and lower surfaces are on opposite sides of a plane, and at least one peripheral outer surface therebetween, at least one of said upper outer surface and lower outer surface having a large central recessed area one of said upper outer surface and lower outer surface also including two first buttress portions at opposing sides with respect to said recessed area and extending to said at least one peripheral outer surface, a first pair of second buttress portions, each of said second buttress portions extending to said at least one peripheral outer surface and disposed adjacent to one of said first buttress portions and further recessed area means for spacing said one of said first buttress portions from said second buttress portions, said recessed area means extending from said central recessed area to said at least one peripheral outer surface, wherein relief holes are provided in at least one of the upper and lower surfaces, at positions other than in the or each central recessed area.

23. A pillow having an upper outer surface, a lower outer surface, said upper and lower surfaces are on opposite sides of a plane, and at least one peripheral outer surface therebetween, at least one of said upper outer surface and lower outer surface having a large central recessed area one of said upper outer surface and lower outer surface also including two first buttress portions at opposing sides with respect to said recessed area and extending to said at least one peripheral outer surface, a first pair of second buttress portions, each of said second buttress portions extending to said at least one peripheral outer surface and disposed adjacent to one of said first buttress portions and further recessed area means for spacing said one of said first buttress portions from said second buttress portions, said recessed area means extending from said central recessed area to said at least one peripheral outer surface, wherein said pillow is of rectangular configuration, having front and rear peripheral outer surfaces, and peripheral outer side surfaces, said first buttress portions being formed by respective front and rear rolls which defines said front and rear peripheral outer surfaces respectively, each of said front and rear rolls also partly defining at its respective opposite ends second buttress portions in the form of corner buttresses, each corner buttress being spaced from its adjacent first buttress portion by a further recessed area is in the form of a minor recess.

* * * * *